US007803224B2

(12) United States Patent
Schliesman et al.

(10) Patent No.: US 7,803,224 B2
(45) Date of Patent: Sep. 28, 2010

(54) PAPER AND COATING MEDIUM FOR MULTIFUNCTIONAL PRINTING

(75) Inventors: Leonard J. Schliesman, Wisconsin Rapids, WI (US); James P. Niemiec, Wisconsin Rapids, WI (US); Fikret Kaya, Wisconsin Rapids, WI (US); Robert S. Van Helden, Appleton, WI (US)

(73) Assignee: Newpage Wisconsin System, Inc., Miamisburg, OH (US)

( * ) Notice: Subject to any disclaimer, the term of this patent is extended or adjusted under 35 U.S.C. 154(b) by 1 day.

(21) Appl. No.: 12/294,115

(22) PCT Filed: Mar. 27, 2007

(86) PCT No.: PCT/US2007/007270

§ 371 (c)(1),
(2), (4) Date: Oct. 31, 2008

(87) PCT Pub. No.: WO2007/112013

PCT Pub. Date: Oct. 4, 2007

(65) Prior Publication Data

US 2009/0131570 A1 May 21, 2009

Related U.S. Application Data

(60) Provisional application No. 60/785,438, filed on Mar. 24, 2006.

(51) Int. Cl.

| | |
|---|---|
| ***C09C 1/02*** | (2006.01) |
| ***C09C 1/00*** | (2006.01) |
| ***B44C 5/00*** | (2006.01) |
| ***B44C 1/16*** | (2006.01) |

(52) U.S. Cl. ..... 106/463; 106/464; 106/465; 106/416; 106/469; 428/32; 428/39; 428/537.5

(58) Field of Classification Search ..... 106/463, 106/464, 465, 416, 469; 428/32.39, 537.5
See application file for complete search history.

(56) References Cited

U.S. PATENT DOCUMENTS

| | | | | |
|---|---|---|---|---|
| 3,197,322 | A | | 7/1965 | Maskal et al. |
| 3,798,047 | A | | 3/1974 | Delfosse |
| 4,714,603 | A | | 12/1987 | Vanderheiden |
| 4,824,654 | A | | 4/1989 | Ota et al. |
| 5,120,365 | A | | 6/1992 | Kogler |
| 5,164,172 | A | | 11/1992 | Katayama et al. |
| 5,269,818 | A | | 12/1993 | Kunesh et al. |
| 5,296,002 | A | | 3/1994 | Passaretti |
| 5,320,897 | A | | 6/1994 | Kondo et al. |
| 5,332,564 | A | | 7/1994 | Chapnerkar et al. |
| 5,418,057 | A | | 5/1995 | Tokiyoshi et al. |
| 5,454,864 | A | * | 10/1995 | Whalen-Shaw ..... 106/416 |
| 5,478,388 | A | | 12/1995 | Gane et al. |
| 5,676,746 | A | | 10/1997 | Brown |
| 5,731,034 | A | | 3/1998 | Husband |
| 5,846,382 | A | | 12/1998 | Von Raven |
| 5,861,209 | A | | 1/1999 | Haskins et al. |
| 5,882,396 | A | | 3/1999 | Hiorns |
| 5,939,036 | A | | 8/1999 | Porter et al. |
| 6,071,336 | A | | 6/2000 | Fairchild et al. |
| 6,156,286 | A | | 12/2000 | Fortier et al. |
| 6,221,146 | B1 | | 4/2001 | Fortier et al. |
| 6,402,824 | B1 | | 6/2002 | Freeman et al. |
| RE38,301 | E | | 11/2003 | Bleakley et al. |
| 6,685,908 | B1 | | 2/2004 | Yaniv |
| 6,863,775 | B2 | | 3/2005 | Bobsein et al. |
| 7,014,893 | B2 | | 3/2006 | Wicher et al. |
| 2004/0255820 | A1 | * | 12/2004 | Chen et al. ..... 106/31.13 |
| 2006/0054291 | A1 | | 3/2006 | Dimmick et al. |
| 2006/0098066 | A1 | | 5/2006 | Bauer |
| 2006/0102304 | A1 | | 5/2006 | Nutbeem et al. |
| 2006/0137574 | A1 | | 6/2006 | Preston et al. |
| 2006/0272549 | A1 | | 12/2006 | Mathur et al. |
| 2006/0292305 | A1 | | 12/2006 | Skuse et al. |

* cited by examiner

*Primary Examiner*—Jerry Lorengo
*Assistant Examiner*—Shuangyi Abu Ali
(74) *Attorney, Agent, or Firm*—Greer, Burns & Crain, Ltd.

(57) ABSTRACT

A paper coating includes a combination of a primary pigment and a secondary pigment. The primary pigment includes anionic particles having a particle size distribution where at least 96% of the particles by weight have a particle size less than 2 microns. The secondary pigment is a cationic, grit-free pigment having an average particle size of 3 microns or less. The coating also includes up to 17 weight % of a hydrophilic styrene-butadiene latex based on the weight of the dry pigments and a co-binder. Another embodiment of this invention is a coated base sheet that includes a base sheet to which the above coating has been applied.

18 Claims, No Drawings

PAPER AND COATING MEDIUM FOR MULTIFUNCTIONAL PRINTING

CROSS REFERENCE TO RELATED APPLICATIONS

This application claims the benefit of the filing date of U.S. Ser. No. 60/785,438, filed Mar. 24, 2006.

BACKGROUND

This invention relates to a coating for paper, a coated paper sheet and a printed paper sheet. More specifically, the coating includes a combination of pigments and binders that lead to improved dry ink times. The sheet is useful for printing using offset, laser and ink jet techniques, including multifunctional printing.

Traditionally, commercial printing presses printed catalogues, brochures and direct mail using offset printing. Addressing of mailings was accomplished in a separate step using labels that were printed with an ink jet or a laser printer. In yet another step, the labels are applied to the offset printed product. By this multi-step process, specialized papers could be used for each different printer, taking advantage of the benefits of each.

Computerization of high speed printing operations has led to convergence of printing techniques by using multiple print devices on the same paper stock. Common parts of a document are printed using techniques for high speed or high quality, then personalized using a different technique. A brochure may be printed on an offset press, with non-image areas left in strategic places for individual information, such as the recipient's name and address, organization, custom products or pricing. The spaces are then imprinted with an ink jet or laser printer with the individualized information. However, conventional papers designed for offset printing may not function well for other printing techniques, such as laser or inkjet printing.

Papers used for ink jet printing must absorb droplets of ink rapidly to perform well in commercial high-speed presses. Aqueous inks are preferred for most applications due to a higher number of droplets per inch. Individual droplets should be absorbed preferably in less than 2 seconds, with the paper absorbing a certain amount of water to prevent ink smearing. Many standard paper grades manufactured for offset printing do not meet this requirement. For example, coating formulations containing more than 50 parts clay per hundred parts dry pigment, more than 5 parts starch, more than 15 parts latex or high binder concentrations in any region of the sheet would not meet the ink jet dry time requirement. Moreover, the carrier absorption must be uniform over the paper surface to assure even tones. Areas of high absorbency absorb more liquid than low absorbency areas, resulting in a mottled or blotchy appearance. This tendency is not detected by porosity measurements, which are averages over segments of the paper surface.

Laser printing applications perform better with a paper base sheet that acts as a thermal insulator. The surface must become sufficiently hot to fuse dry toner to the paper. If the paper conducts heat too readily, the surface will not become sufficiently hot to allow the toner to melt and produce a good image. Coatings for laser printing processes are formulated to hold heat near the surface of the base sheet.

Ideal papers for offset printing must absorb fountain solution from the emulsified ink or from a non-image area of the offset printing plate as well as the ink vehicle, usually oil. Offset printing is commonly used for color printing which requires multiple ink layers. The ink vehicle is absorbed at a controlled rate, known as the tack rate, such that enough oil is absorbed to set the ink, but leaves the ink sufficiently tacky to accept the next layer of ink as the paper continues through the press.

It has come to light that pigmented ink jet inks are particularly difficult to absorb evenly, especially on cationic coatings. When pigmented inks are absorbed, the pigments are held out on the coating surface, often blocking the pores so that it is difficult to develop wet resistance. Colors that are blended using several ink passes can require three or more ink coatings. If the pigments from the first two passes block the pores, the ink vehicle is not absorbed on the third and subsequent passes. This results in a poor image and inks that run in the presence of water.

Due to the many and varied demands on the paper substrate, no commercial paper is known that performs well for offset, ink jet and laser printing techniques. In order to make a coating and a printing paper that produces good print quality when printed by multiple processes, the coating must rapidly absorb water and ink oil, each at an appropriate rate, and retain heat at the surface of the sheet.

SUMMARY OF THE INVENTION

A paper coating includes a combination of a primary pigment and a secondary pigment. The primary pigment includes anionic particles having a particle size distribution where at least 96% of the particles by weight have a particle size less than 2 microns. The secondary pigment is a cationic, grit-free pigment having an average particle size of 3 microns or less. The coating also includes up to 17 weight % of a hydrophilic styrene-butadiene latex based on the weight of the dry pigments and a co-binder.

Aragonite is a preferred precipitated calcium carbonate that differs from other forms of calcium carbonate in both particle shape and size distribution. It is particularly useful as the primary pigment. Aragonite has a needle-like structure and a narrow particle size distribution making it particularly suitable as the primary pigment. While not wishing to be bound by theory, it is believed that the structure discourages tight particle packing of the pigment and provides the porosity needed for good ink absorption from different printing techniques. Use of the aragonite form produces a surface on the treated paper having a controlled porosity that allows it to perform well with any printing process. It is ideal for multifunctional printing where two or more print methods are used on a single printed product.

Another embodiment of this invention is a coated sheet that includes a base sheet to which the above coating has been applied. The coated sheet is highly absorbent for many types of ink. It quickly absorbs ink from several passes of an ink jet printer. The paper also provides a good image from laser and web offset printing processes. This makes it particularly useful in multifunctional printing.

The coating and coated base sheet of the instant invention are particularly useful with pigmented ink jet inks. Limited use of the secondary cationic pigment allows some interaction between the cationic particles and the anionic binder and primary pigment that opens the pores and improves the porosity of the coating. When third and subsequent layers of ink are applied, the vehicle is able to be uniformly absorbed by the coating, even when pigmented inks are used. All dry times are reported in seconds.

DETAILED DESCRIPTION OF THE INVENTION

An anionic coating for a multifunctional paper includes at least two pigments, a primary pigment and a secondary pigment. The primary pigment is a narrow particle size distribution, fine, anionic pigment. The secondary pigment is a cationic pigment. Further, the coating includes a hydrophilic styrene/butadiene resin and a co-binder. When this coating is applied to a base sheet, a modified offset printing paper is produced that also performs well with ink jet and laser printers. Pigments comprise the largest portion of the coating composition on a dry weight basis. Unless otherwise noted, amounts of component materials are expressed in terms of component parts per 100 parts of total pigment on a weight basis.

The primary component of the coating is an anionic pigment having a narrow particle size distribution where 96% of the particles are less than 2 microns in diameter. Preferably, at least 80% by weight of the particles should be less than 1 micron and fall within the range of 0.1-1μ. A more preferred distribution has at least 85% of the particles less than 1 micron and fall in the range of 0.1-1 microns. In another preferred embodiment, 98% of the particles are less than 2 microns in diameter. Yet another preferred embodiment uses a calcium carbonate wherein about 98% of the particles fall in the range of 0.1-1.0 microns. The primary pigment is from about 50 to about 90 parts of the total pigment by weight. Preferred pigments include calcium carbonate in the form of aragonite, calcite or combinations thereof.

Calcium carbonate is useful as the primary pigment in any form, including aragonite, calcite or mixtures thereof. Calcium carbonate preferably makes up 50-90 parts of the coating pigment on a dry weight basis. Preferably, the calcium carbonate is from about 70 to 80 parts of the pigment weight. Aragonite is a preferred calcium carbonate. An advantage to using aragonite as the primary pigment is that the porous structure of the coating better withstands calendering to give it a gloss finish. When other forms of calcium carbonate are used in coatings, surface pores can be compacted so that some absorbency can be lost before a significant amount of gloss is achieved. A preferred aragonite is Specialty Minerals OPACARB A40 pigment (Specialty Minerals, Inc. Bethlehem, Pa.). A40 has a particle size distribution where 99% of the particles have a diameter of from about 0.1 to about 1.1 microns.

For the primary pigment, an alternate calcium carbonate having a narrow particle size distribution is OMYA CoverCarb85 ground calcite calcium carbonate (OMYA AG, Oftringen, Switzerland). It provides the porous structure for successful ink absorption but less paper gloss development. This calcium carbonate preferably has a particle size distribution where 99% of the particles have a diameter less than 2 microns.

The secondary pigment is a cationic pigment. It is added to the coating which, when fully assembled, has an overall anionic nature. Attractive forces between the anionic coating and cationic pigment are believed to open up surface pores in the coating, increasing the porosity and the ink absorption rate. Ink drying times are also reduced. Additionally, since the ionic interaction is on a very small scale, the improved porosity is uniform over the coating surface.

The particle size distribution of the secondary pigment has an average particle size less than 3.0 microns and is grit-free. The term "grit-free" is intended to mean there are substantially no particles on a 325 mesh screen. Preferably, substantially all of the particles in the secondary pigment are sized at less than 1 micron. Amounts of the secondary pigment are limited to less than 20 parts based on 100 parts by weight of the total pigment. Use of excessive cationic component leads to undesirable ionic interaction and chemical reactions that change the nature of the coating. The secondary pigment is preferably present in amounts greater than 5 parts cationic pigment per 100 total parts pigment. Secondary pigments include carbonates, silicates, silicas, titanium dioxide, aluminum oxides and aluminum trihydrates. Preferred secondary pigments are cationics OMYAJET B and C pigments (OMYA AG, Oftringen, Switzerland), calcium carbonates.

Supplemental pigments are optional anionic pigments used in this formulation as needed to improve gloss, whiteness or other coating properties. Up to an additional 30 parts by weight of the dry coating pigment is an anionic supplemental pigment. Up to 25 parts, preferably less than 20 parts, of the pigment is a coarse ground calcium carbonate, another carbonate, plastic pigment, $TiO_2$, or mixtures thereof. An example of a ground calcium carbonate is Carbital 35 calcium carbonate (Imerys, Roswell, Ga.). Another supplemental pigment is anionic titanium dioxide, such as that available from Itochu Chemicals America (White Plains, N.Y.). Hollow spheres are the preferred plastic pigments for paper glossing. An example of a hollow sphere pigment is ROPAQUE AF-1055 (Rohm & Haas, Philadelphia, Pa.). Higher gloss papers are obtainable when fine pigments are used that have a small particle size. The relative amounts of the supplemental pigments are varied depending on the whiteness and desired gloss levels.

A primary binder is added to the coating for adhesion. The primary binder is anionic and is preferably a hydrophilic styrene/butadiene latex ("SBR Latex"). Optionally, the latex co-polymer also includes up to 20% by weight acrylonitrile repeating units. SBR Latex is a carboxylated styrene butadiene copolymer latex admixture and may contain acrylonitrile. Highly hydrophilic polymers are preferred. Preferred polymers include Genflo 5915 SB Latex polymer, Genflo 5086 SB Latex polymer and Gencryl 9750 ACN Latex polymers (all available from RohmNova, Akron, Ohio). The total amount of binders is from about 10 to about 20 weight % per 100 parts of total pigments.

Another feature of the coating is a co-binder that is used in addition to the primary binder. The most preferred co-binders are polyvinyl alcohol or a protein binder. The co-binder is used in amounts of about 2 to about 4 parts co-binder per 100 parts of pigment on a dry weight basis, preferably from about 2 to 3 parts co-binder per 100 parts dry pigment. Another co-binder that is useful in some embodiments is starch. Both cationic and anionic starches are used as a co-binder. ADM Clineo 716 starch is a preferred ethylated cornstarch (Archer Daniels Midland, Clinton, Iowa). If a cationic co-binder is used, the amount used is limited so that the overall anionic nature of the coating is maintained.

In some embodiments of the invention, the coating is free of any additives that interfere with the surface pore structure. Although the starch is preferred from a cost perspective and its ability to improve surface smoothness, improved ink dry time performance is obtained from starch free coatings. Starch also has a tendency to fill surface voids and eliminate surface pores. Preferably, starch is used as a co-binder only if the coating is applied in one pass per side to an unsized paper. In other embodiments, the coating is free of starch. Still other embodiments are free of clay.

Other optional additives are used to vary properties of the coating. Brightening agents, such as Clariant T26 Optical Brightening Agent, (Clariant Corporation, McHenry, Ill.) are used. Insolubilizers or cross-linkers are useful. A preferred cross-linker is Sequarez 755 (RohmNova, Akron, Ohio). A lubricant is optionally added to reduce drag when the coating is applied with a blade coater.

Conventional mixing techniques are used in making this coating. If starch is used, it is cooked prior to preparing the coating using a bench-top starch cooker. The starch is made down to approximately 35% solids. Separately, all of the pigments, including the primary pigment, secondary and any supplemental pigments, are mixed for several minutes to ensure no settling has occurred. In the laboratory, the pigments are mixed on a drill press mixer using a paddle mixer. The primary binder is then added to the mixer, followed by the co-binder 1-2 minutes later. If starch is used, it is added to the mixer while it is still warm from the cooker, approximately 190° F. The final coating is made by dispersion of the mixed components in water. Solids content of the dispersion is preferably from 55% to about 68% by weight. More preferably, the solids are about 58% to about 62% of the dispersion by weight.

Yet another embodiment is an improved printing paper for multifunctional printing having a base sheet to which the coating has been applied on at least one printing surface. Any coating method or apparatus may be used, including, but not limited to, roll coaters, jet coaters, blade coaters or rod coaters. The coating weight is preferably about 2 to about 7 pounds per 3300 $ft^2$ per side, to size press, pre-coated or unsized base papers. Coated papers would preferably range from 30 lb. to about 250 lb./3300 $ft^2$ of paper surface. The coated paper is then optionally finished as desired to the desired gloss.

The substrate or base sheet is preferably a conventional base sheet designed for offset printing. This sheet absorbs the fountain solution and organic ink vehicle at an appropriate tack rate. Examples of useful base sheets are NewPage 60 lb. Web Offset base paper, Orion, and NewPage 105 lb. Satin Return Card Base Stock, both from NewPage Corporation (Wisconsin Rapids, Wis.).

The finished coated paper is useful for printing, particularly multifunctional printing. Ink is applied to the coating to create an image. After application, the ink vehicle penetrates the coating and is absorbed therein. The number and uniformity of the coating pores result in even and rapid ink absorption, even when multiple layers of ink are applied. This coated paper is also particularly well suited for multifunctional printing, whereby an image on a coated paper media is created from combinations of dyes or pigmented inks from ink jet printers, toner from laser printers and inks from offset or gravure or flexo presses.

Photomicrographs indicate that the surface of these papers have a very large number and uniform distribution of small particles. Use of these particles provides pores that allow the coating to absorb the organic offset ink vehicle, as well as the aqueous ink-jet ink vehicle. The coating produces good print quality and acceptable absorption times even on high-speed presses. Pores of this nature also act as thermal insulators, keeping the heat of a laser fusing process near the surface of the coating to quickly melt and fuse the dry toner.

In testing commercial papers, it has been found that a single droplet of ink jet ink should be absorbed in less than two seconds on commercial high speed presses. It has been determined that a lab test procedure gives dry times that correlate to high speed applications in commercial ink-jet printing processes. Values of this test ("NP Test") roughly correlate to single drop commercial drying times as shown in Table I. As shown in Example 1, testing revealed that most standard paper grades manufactured for offset printing does not meet the 60 second drying time limit using the NP Test, and therefore would not produce a good print quality from an ink jet printer.

To determine the NP Test Dry Time, a Hewlett-Packard 560 ink jet printer was loaded with ink and the paper sample to be tested. The printer was instructed to print two 20 mm×34 mm solid rectangles. There are 4 or 8 drops sprayed per pixel. When printing was complete, a timer was started. When all liquid disappears (as measured by a lack of glossy spots), the timer was stopped. Initially, 30 second dry times were considered satisfactory. More recent testing indicates that dry times of less than 15 seconds or less than 10 seconds are more preferred.

Overall print quality is judged by a number of factors. When printing text, the appearance should not show excessive spraying, feathering or wicking. An area fill should have uniform color and be visually acceptable. Unacceptable properties include mottling, cascading, bronzing, loose paper fibers and low image density. Non-uniform ink vehicle absorption can result in mottling.

TABLE I

| Single Droplet Dry Times | NP Test Dry Times |
|---|---|
| 1 second | 15 seconds |
| 2 seconds | 30-60 seconds |
| 3 seconds | 60-180 seconds |

In the following examples, where no units are shown, the pigments are reported in parts on a weight basis. The remaining components are reported as parts per 100 parts of pigment, on a weight basis.

EXAMPLE 1

Comparative Example

Commercial offset printing papers were tested using the NP Dry Time Test for drying time as described above. Standard NewPage 60 lb. Web Offset paper, Orion, (NewPage, Kimberly, Wis.) had a NP Test Dry Time of 180 seconds. NewPage 105 lb. Satin Return Card Stock (NewPage Wisconsin Rapids, Wis.) had a NP Test Dry Time of 115 seconds. Neither of these commercial products met the recommended NP Test time of <60 seconds, which would correspond to a Single Drop Dry Time of less than 2 seconds.

EXAMPLE 2

Coatings were prepared from the components of Table II. A40 is an anionic, precipitated aragonite, Opacarb A40 by Specialty Minerals, and serves as the primary pigment. The secondary pigment is OMYAJET B. AF 1055 refers to the plastic pigment by RohmNova, Akron, Ohio. C35 is an anionic, course $CaCO_3$ available from Imerys Minerals Ltd., Cornwall, England. It is a supplemental pigment. The three latex polymer binders tested are Genflo 5915 styrene/butadiene latex ("5915 SBR"), Gencryl 9750 acrylonitrile latex ("9750 ACN") and Genflo 5086 styrene/butadiene ("5086 SBR") latex discussed above. The type and amount of latex tested is shown in Table II. ADM 716 refers to Clineo 716 ("ADM 716") cornstarch by Archer Daniels Midland, a co-binder. Sequarez 755 is a crosslinker available from RohmNova, Akron, Ohio. Clariant T 26 OBA ("T26 OBA") is an optical brightener by Clariant Corporation, McHenry, Ill. The ADM 716 starch was cooked and the coating prepared as described above.

TABLE II

| Composition of Coating Samples | | | | | | | | | |
|---|---|---|---|---|---|---|---|---|---|
| Component | 60231 | 70012 | 70013 | 70014 | 70015 | 70016 | 70017 | 70018 | 70019 |
| A40 | 70 | 70 | 70 | 70 | 70 | 70 | 70 | 70 | 70 |
| AF 1055 | 8 | 8 | 8 | 8 | 8 | 8 | 8 | 8 | 8 |
| $TiO_2$ | 7 | 7 | 7 | 7 | 7 | 7 | 7 | 7 | 7 |
| Omyajet B | 15 | 0 | 0 | 0 | 0 | 0 | 15 | 15 | 0 |
| C35 | 0 | 15 | 15 | 15 | 15 | 15 | 0 | 0 | 15 |
| 5915 SBR | 14.5 | 13.5 | 15.5 | 0 | 0 | 0 | 0 | 0 | 0 |
| 9750 ACN | 0 | 0 | 0 | 0 | 13.5 | 15.5 | 15.5 | 17.5 | 13.3 |
| 5086 SBR | 0 | 0 | 0 | 15.5 | 0 | 0 | 0 | 0 | 0 |
| ADM 716 | 4 | 4 | 4 | 4 | 4 | 4 | 4 | 4 | 4 |
| Sequarez 755 | 0.5 | 0.5 | 0.5 | 0.5 | 0.5 | 0.5 | 0.5 | 0.5 | 0.5 |
| T26 OBA | 3 | 3 | 3 | 3 | 3 | 3 | 3 | 3 | 3 |

Each of the samples was tested for properties as they were coated onto a substrate. Coating test results of the samples are shown in Table III. The coating weight is reported in pounds per 3300 $ft^2$.

TABLE III

| | Sample | | | | | | | | |
|---|---|---|---|---|---|---|---|---|---|
| | 60231 | 70012 | 70013 | 70014 | 70015 | 70016 | 70017 | 70018 | 70019 |
| % solids | | 57.28 | 57.29 | 57.46 | 57.29 | 56.91 | 51.49 | 51.05 | 55.81 |
| pH | | 7.86 | 7.80 | 8.00 | 8.17 | 8.19 | 8.14 | 8.27 | 8.33 |
| % Grit ($\times 10^{-3}$) | | 3.5 | 5.8 | 8.7 | 9.9 | 11.1 | 30.4 | 39.2 | 14.9 |
| Coat Wt. | 6.5 | 6.58 | 6.54 | 6.58 | 6.59 | 6.60 | 6.46 | 6.59 | 6.51 |
| Basis Wt. | 53.21 | 48.55 | 48.92 | 47.89 | 47.96 | 47.88 | 49.40 | 49.20 | 49.40 |
| Brookfield Low shear viscosity (CPs): | | | | | | | | | |
| @ 20 rpm | | 2200 | 2350 | 2350 | 2000 | 1300 | 3400 | 4000 | 1350 |
| @100 rpm | | 720 | 880 | 730 | 720 | 460 | 1160 | 1340 | 460 |
| Hercules high shear viscosity 4400 rpm: | | | | | | | | | |
| Deflection | | 6.94 | 6.26 | 5.57 | 6.16 | 5.71 | 6.84 | 6.40 | 5.90 |
| Peak | | 60.3 | 54.3 | 48.4 | 53.5 | 49.6 | 59.4 | 55.6 | 51.2 |

After the coating was applied to a substrate, physical tests were performed on the coated base sheets to determine the properties of the coated paper. All samples were coated on the wire side of an unsized base paper. It is an untreated base paper made at NewPage, Kimberly Mill on 96 Machine for 60 lb. Orion. Results of physical tests are shown in Table IV.

TABLE IV

| | Sample | | | | | | | | |
|---|---|---|---|---|---|---|---|---|---|
| | 60231 | 70012 | 70013 | 70014 | 70015 | 70016 | 70017 | 70018 | 70019 |
| Brightness | 92.80 | 91.99 | 91.96 | 91.81 | 91.88 | 91.62 | 92.23 | 91.78 | 92.29 |
| L | 94.56 | 94.61 | 94.33 | 94.24 | 94.31 | 94.22 | 94.69 | 94.57 | 94.45 |
| "a" color | 1.02 | 0.75 | 0.67 | 0.69 | 0.71 | 0.71 | 0.37 | 0.39 | 0.79 |
| "b" color | −1.96 | −1.52 | −1.46 | −1.49 | −1.46 | −1.38 | −1.04 | −0.90 | −1.57 |
| Fluorescence | 3.56 | 3.32 | 3.37 | 3.54 | 3.42 | 3.40 | 3.27 | 3.21 | 3.50 |
| Whiteness | | 94.87 | 95.35 | 95.36 | 95.37 | 94.82 | 94.20 | 93.41 | 96.11 |
| 75° gloss | 77.6 | 64.98 | 65.22 | 67.71 | 63.01 | 60.86 | 71.73 | 67.58 | 62.84 |

Printing tests were carried out on each of the base sheets covered with each of the coatings prepared above. Prior to printing, all sheets were supercalendared at 1200 pli, 100° F., 25 feet per minute and 3 nips.

Optical density was measured by printing an area solid with a single ink color. The lightest areas in the fill area are visually located. The reflection density was measured using a Macbeth Densitometer having an aperture no larger than 2 mm. These readings are averaged. Next the five darkest areas are located visually and the reflection density is again measured with the densitometer. Results of these tests are shown in Table V.

TABLE V

| | Sample | | | | | | | | |
|---|---|---|---|---|---|---|---|---|---|
| | 60231 | 70012 | 70013 | 70014 | 70015 | 70016 | 70017 | 70018 | 70019 |
| Optical Density | | 1.57 | 1.51 | 1.52 | 1.53 | 1.51 | 1.50 | 1.47 | 1.52 |
| Dry Time | 5 | 15 | 19 | 40 | 31 | 32 | 14 | 21 | 19 |
| Repeat Dry Time | | 15 | 23 | 46 | 39 | 41 | 15 | 22 | 27 |
| IGT | 1 | 2 | 6 | 8 | 7 | 9 | 3 | 5 | 4 |

The bottom row of Table V indicates the IGT Instantaneous Absorption rating. Fluids are printed in a nip so that the fluids are smeared almost immediately. Ink that is not absorbed instantaneously is moved to another portion of the sample. Uniformity of absorption is shown by light or dark areas of the stain. The density and uniformity of density of the resulting stains is visually rated. This test is intended to assess microvariations in absorption, not average absorption as in other standard tests. Even very small unstained areas are undesirable. The above samples were visually rated, and the rank of each sample is shown above, with the most uniform sample being rated 1.

As can be seen from the data, samples of the present invention, samples 60231, 70017 and 70018 have three of the four fastest drying times and three of the top five IGT rankings.

EXAMPLE 3

As sold, OMYAJET B pigment is normally cationic. Upon request, a sample was prepared by the manufacturer exactly like OMYAJET B pigment, except it is an anionic form. Coatings were made from both the anionic and cationic forms of OMYAJET B pigment to determine if the ionic charge had a significant effect on the coating performance. The coating formulations are shown in Table VI.

TABLE VI

| Component | 060230 | 060231 |
|---|---|---|
| HF 90 Clay | 0 | 0 |
| Plastic Pigment | 8 | 8 |
| $TiO_2$ | 7 | 7 |
| A40 Aragonite | 70 | 70 |
| OMYA B Anionic | 15 | 0 |
| OMYA B Cationic | 0 | 15 |
| SB Latex | 14.5 | 14.5 |
| Starch | 4 | 4 |
| OBA | 3 | 3 |

The above coatings were coated onto one side of a plain, unsized base sheet using a blade coater. Coating and basis weights for each sample are shown in Table VII.

TABLE VII

| Component | 060230 | 060231 |
|---|---|---|
| Coat Weight | 6.5 | 6.5 |
| Basis Weight | 54.28 | 53.21 |

Test patterns were printed on each of the test sheets generated using the above coatings. Results of printing tests are shown in Table VIII.

TABLE VIII

| Component | 060230 | 060231 |
|---|---|---|
| Dry Time (sec.) | 21 | 5 |
| Penetration to Base Sheet | Moderate | Moderate |
| Bronzing | No | No |
| 75° Gloss | 76.6 | 77.6 |
| Brightness | 92.83 | 92.80 |
| L | 94.32 | 94.56 |
| "a" color | 1.25 | 1.02 |
| "b" color | −2.41 | −1.96 |
| Fluorescence | 3.92 | 3.56 |

Use of the cationic calcium carbonate pigment in sample 060231 results in a significantly shorter drying time compared to the formulation that includes anionic calcium carbonate (060230). It is believed that interaction and attraction between the cationic and anionic particles expand the spacing between the particles, allowing the ink vehicle to penetrate the coating and be absorbed. This phenomenon would not occur in coatings where all pigments are either all cationic or anionic in nature.

EXAMPLE 4

Another grit-free, cationic calcium carbonate having an average particle size less than 3 microns was tested for use as the secondary pigment. XC-3301 Cationic (now known as OmyaJet C) is a proprietary pigment of Omya AG, Oftringen, Switzerland. Coating compositions were blended as described above according to the formulations of Table IX. The resulting coatings were coated to the wire side of an uncoated base paper for offset printing at the rate of 6.5 lb./3300 $ft^2$ of paper surface. Results of the NP Dry Time tests are also shown in the table below.

TABLE IX

| Composition of Coating Samples | | |
|---|---|---|
| Component | 70116 | 70124 |
| A40 | 70 | 70 |
| AF 1055 | 8 | 8 |
| $TiO_2$ | 7 | 7 |
| Omyajet B Cationic | 7.5 | 0 |
| XC-3301 Cationic | 0 | 7.5 |
| C35 | 7.5 | 7.5 |
| 5915 SBR | 13.5 | 13.5 |
| ADM 716 | 4 | 4 |
| Sequarez 755 | 0.5 | 0.5 |
| NP Dry Time | 6 | 9 |

The NP dry time of both cationic secondary pigments fall within the preferred dry time of less than 15 seconds.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention. Statements of theory are intended to aid in the understanding of the invention only, and are not to limit the invention in any way.

What is claimed is:

1. An anionic coating for a paper base sheet comprising:

an anionic, inorganic primary pigment having a particle size distribution where at least 96% of the particles by weight have a particle size less than 2 microns;

at least one cationic, grit-free, inorganic secondary pigment having an average particle size of 3 microns or less;

from 6% to 17 weight % latex binder based on the weight of the dry pigments, wherein said latex binder is an anionic hydrophilic styrene/butadiene latex; and a co-binder.

2. The coating of claim 1 wherein at least one of said primary pigment and said secondary pigment comprises calcium carbonate.

3. The coating of claim 2 wherein said primary pigment comprises aragonite.

4. The coating of claim 1 wherein said secondary pigment has a particle size distribution wherein substantially all particles are less than 1 micron.

5. The coating of claim 1 wherein said secondary pigment comprises at least one of the group consisting of titanium oxide, a carbonate, aluminum oxide, aluminum trihydrate, a silica, a silicate and mixtures thereof.

6. The coating of claim 1 further comprising one or more supplemental anionic pigments selected from the group consisting of carbonates, plastic pigments, titanium oxides and mixtures thereof, wherein said supplemental pigments total 30 parts or less based on 100 parts total pigments.

7. The coating of claim 1 wherein said coating is clay free.

8. The coating of claim 1 wherein said coating is starch free.

9. The coating of claim 1 wherein said co-binder is at least one of the group consisting of protein binders, polyvinyl alcohol, starch and mixtures thereof.

10. A coated base sheet for multifunctional printing, comprising:

a base sheet; and a coating of claim 1 applied to said base sheet.

11. The sheet of claim 10 wherein said coating is present in amounts of about 2 to about 7 pounds coating per 3300 $ft^2$ of base sheet surface area.

12. The sheet of claim 10, wherein said primary pigment comprises calcium carbonate.

13. The sheet of claim 12 wherein said primary pigment is aragonite.

14. The sheet of claim 10 wherein said secondary pigment comprises at least one of the group consisting of titanium oxide, a carbonate, aluminum oxide, aluminum trihydrate, a silica, a silicate and mixtures thereof.

15. The sheet of claim 10 having a NP Dry Time of 15 seconds or less when absorbing ink jet inks.

16. The sheet of claim 10 wherein said coating is starch free.

17. The sheet of claim 10 wherein said co-binder is at least one of the group consisting of protein binders, polyvinyl alcohol, starch and mixtures thereof.

18. The coated base sheet of claim 10, wherein said secondary pigment comprises at least one of the group consisting of titanium oxide, a carbonate, aluminum oxide, aluminum trihydrate, a silica, a silicate and mixtures thereof.

* * * * *

UNITED STATES PATENT AND TRADEMARK OFFICE

CERTIFICATE OF CORRECTION

PATENT NO. : 7,803,224 B2
APPLICATION NO. : 12/294115
DATED : September 28, 2010
INVENTOR(S) : Schliesman et al.

It is certified that error appears in the above-identified patent and that said Letters Patent is hereby corrected as shown below:

On the Title Page;

Under (22) PCT Filed, delete "March 27, 2007" and replace with --March 23, 2007--

Signed and Sealed this
Nineteenth Day of April, 2011

David J. Kappos

David J. Kappos
*Director of the United States Patent and Trademark Office*